US005712554A

United States Patent [19]

Lace

[11] Patent Number: 5,712,554

[45] Date of Patent: Jan. 27, 1998

[54] VOLTAGE COMPENSATION DEVICE

[75] Inventor: Melvin A. Lace, Prospect Heights, Ill.

[73] Assignee: Thomas E. Dorn, Clarendon Hills, Ill.; a part interest

[21] Appl. No.: 662,126

[22] Filed: Jun. 12, 1996

Related U.S. Application Data

[63] Continuation-in-part of Ser. No. 568,249, Dec. 22, 1995, abandoned.

[51] Int. Cl.[6] ..... G05F 1/24

[52] U.S. Cl. ..... 323/259; 323/245

[58] Field of Search ..... 323/245, 247, 323/255, 259, 359; 363/21, 59, 74

[56] References Cited

U.S. PATENT DOCUMENTS

| | | | |
|---|---|---|---|
| 1,818,589 | 8/1931 | Thornton et al. . | |
| 2,036,305 | 4/1936 | Snyder . | |
| 2,063,693 | 12/1936 | McCarty | 323/259 |
| 2,090,671 | 8/1937 | Gay . | |
| 2,282,838 | 5/1942 | Whitmore | 323/259 |
| 2,292,829 | 8/1942 | Garin . | |
| 2,349,682 | 5/1944 | Snyder . | |
| 3,199,020 | 8/1965 | Hilker | 323/259 |
| 3,230,414 | 1/1966 | Karger . | |
| 3,243,749 | 3/1966 | Zlachevsky . | |
| 3,452,311 | 6/1969 | Beck et al. . | |
| 3,621,374 | 11/1971 | Kettler | 323/343 |
| 4,500,829 | 2/1985 | Specht et al. . | |
| 4,837,497 | 6/1989 | Leibovich . | |
| 5,355,295 | 10/1994 | Brennen | 363/40 |
| 5,545,971 | 8/1996 | Gomez et al. | 323/259 |

*Primary Examiner*—Stuart N. Hecker

*Attorney, Agent, or Firm*—Dorn, McEachran, Jambor & Keating

[57] ABSTRACT

A voltage compensation device for a two-conductor A.C. power line supplying one or more air conditioners, a telephone system or other telecommunication system, or some other utilization system that requires an input voltage within a given range. The device includes a transformer having electromagnetically coupled primary and secondary windings with the primary and secondary each connected to at least one output terminal. One winding is connected to add voltage to the A.C. line voltage when the line voltage drops below a given low voltage threshold, and in bucking (subtractive) relation when the A.C. line voltage exceeds a given high voltage threshold. When the A.C. line voltage is in the range required by the utilization system, the one winding is effectively shorted out or otherwise disconnected. A sensor for the line voltage actuates one or more relays connected to the transformer to effect the desired compensation action. The voltage compensation device may handle either under-voltage conditions or over-voltage conditions, or both. In one embodiment the one winding is split to afford two levels of voltage compensation both for under-voltage and over-voltage conditions.

12 Claims, 6 Drawing Sheets

(NORMAL-INPUT)

(LOW INPUT; RELAY 38 ACTUATED)

(HIGH INPUT; RELAY 32 ACTUATED)

VOLTAGE COMPENSATION DEVICE

This patent application is a continuation-in-part of a prior patent application Ser. No. 08/568,249 filed Dec. 22, 1995 and now abandoned.

BACKGROUND OF THE INVENTION

A variety of different electrically—energized utilization devices or systems require an A.C. input within a given voltage range. One example is an A.C. energized air conditioner; if the A.C. line energizing the air conditioner drops below a given threshold level for a substantial period of time, the air conditioner may overheat and may suffer permanent damage. Another example is a telephone or other telecommunication system that requires A.C. input signals in a given voltage range. When the input exceeds a threshold at the upper limit of that range, for a period of time, the system may be severely damaged or even virtually destroyed. Other utilization devices may react adversely to inputs either above or below their normal input range; this is particularly true of communications systems.

Compensation circuits have been proposed for both over-voltage and under-voltage A.C. power line conditions. For the most part, known voltage compensation devices have been relatively large and expensive. Indeed, the cost of an effective voltage compensation device may be comparable to the cost of the utilization apparatus that it protects.

SUMMARY OF THE INVENTION

It is a principal object of the invention to provide a new and improved voltage compensation device that maintains the A.C. voltage applied to a utilization device within a given normal range despite substantial variation of an A.C. energization line above or below that range.

Another object of the invention is to provide a new and improved circuit for a voltage compensation device that employs switching of just one transformer winding to compensate for both under-voltage and over-voltage conditions for an A.C. line connected to a utilization device which functions best within a given input voltage range.

A further object of the invention is to provide a new and improved voltage compensation device that is small, simple, durable and inexpensive.

Accordingly, in a preferred aspect the invention relates to a voltage compensation device for an A.C. line subject to variations above or below a predetermined normal line voltage range, the circuit of the compensation device comprising first and second input terminals connectable to an A.C. line to derive an input voltage $v_{IN}$ therefrom; the A.C. line is subject to variations both above and below a predetermined normal line voltage range. First and second output terminals connectable to a utilization device are provided. There is a transformer having electromagnetically coupled first and second windings and having an inter-winding voltage ratio exceeding 2:1. Each winding of the main transformer is connected to a given output terminal. Sensor means, connected to the input terminals, are provided for generating an actuating signal indicative of the voltage $V_{IN}$ between the input terminals. Switching means, connected to one winding of the transformer and to the sensor means, are provided for connecting that one winding of the transformer in additive relation to the other winding when the input voltage $V_{IN}$ is below a low threshold voltage, for connecting the one winding of the transformer in bucking relation to the other winding when the input voltage $V_{IN}$ is above a high threshold voltage, and for effectively disconnecting the one winding of the transformer when the input voltage is within the normal range, above the low voltage threshold and below the high voltage threshold.

DESCRIPTION OF THE PREFERRED EMBODIMENTS

Figure 1:
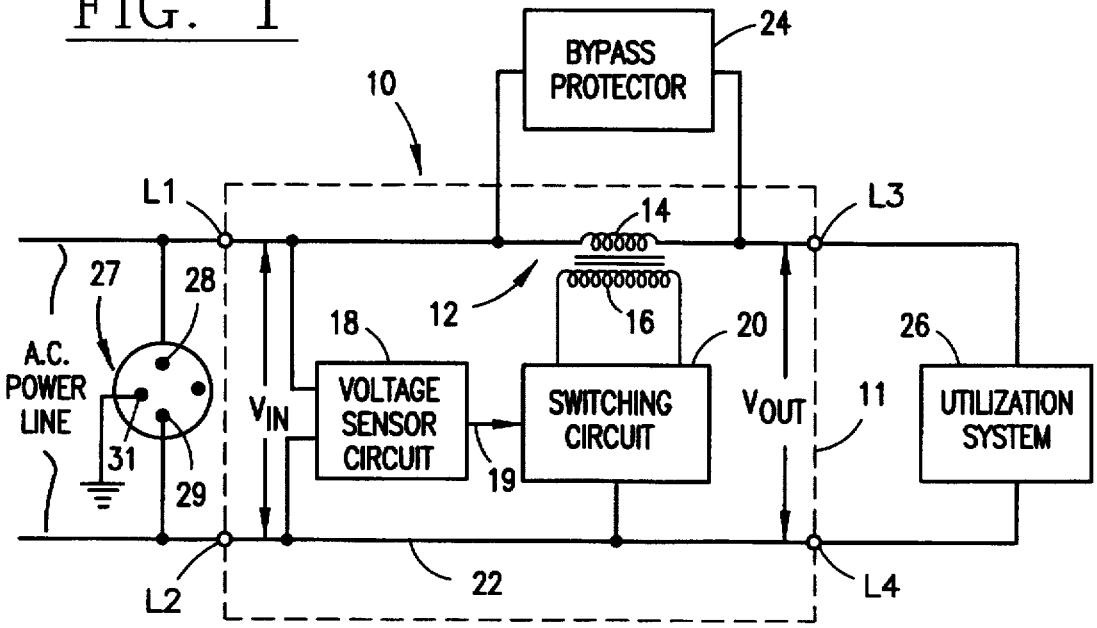
FIG. 1 is a block diagram of a preferred embodiment of the invention.

FIG. 1 is a block diagram of a system 10 that includes a voltage compensation device 11 constructed in accordance with a preferred embodiment of the invention. The A.C. power line at the left-hand side of FIG. 1, which is subject to appreciable voltage variations either above or below a predetermined desired line voltage range, is connected to two input terminals L1 and L2 for circuit 11. Compensation circuit 11 includes a main transformer 12 having a secondary winding 14 electromagnetically coupled to a primary winding 16. The primary:secondary voltage ratio is above 2:1. The secondary winding 14 of transformer 12 is connected in series between an input terminal L1 and output terminal L3 of circuit 11. Circuit 11 also includes another output terminal L4 connected to input terminal L2 by a conductor 22.

Compensation device 11 further includes a voltage sensor circuit 18 for sensing the voltage $V_{IN}$ between the input terminals L1 and L2; $V_{IN}$ is the same as the A.C. voltage on the power line to which compensation circuit 11 is connected. The output of sensor circuit 18 is an actuating signal applied to a switching circuit 20 via a conductor 19. Switching circuit 20 is also connected to the opposite ends of the primary winding 16 of transformer 12 and to the conductor 22 that is connected from input terminal L2 to output terminal L4. A bypass protector circuit 24 is shown, connected in parallel with the secondary winding 14 of transformer 12. An air conditioner, a communication device or system, a computer, a computer system, or some other utilization system 26 is connected to and energized from the output terminals L3 and L4 of compensation circuit 11. A "crowbar" device 27 may be associated with device 11 for transient surge protection. In FIG. 1 device 27 is shown as a three-electrode gas discharge tube 27 having one electrode 28 connected to terminal L1, another electrode 29 connected to terminal L2, and a third electrode 31 connected to ground.

Operation of system 10, FIG. 1, can now be considered. When the A.C. input voltage $V_{IN}$ is within the normal line voltage range for the air conditioner, communication apparatus, computer, or other utilization system 26, the transformer primary 16 is effectively short-circuited or otherwise inactivated by switching circuit 20. That is, primary 16 contributes nothing to the $V_{OUT}$ voltage across terminals L3 and L4, the energizing voltage supplied to utilization system 26. Further, the impedance of secondary winding 14 is quite low, so that the secondary winding exhibits minimal losses. Accordingly, utilization system 26 is energized by an A.C. input, $V_{OUT}$, that is within its normal, desired operating range. Losses in compensation circuit 11 are minimal, and do not adversely affect the operation of system 26.

For low-voltage compensation, when the input voltage $V_{IN}$ to compensation device 11 falls below a first threshold value, the reduction in input voltage causes sensor 18 to generate an actuating signal, on line 19, to actuate switching circuit 20 to connect the primary 16 of transformer 12 to the conductor 22 that interconnects to terminals L2 and L4 in an orientation that adds the voltages from transformer primary 16 and secondary 14 together to develop the output voltage $V_{OUT}$ supplied to utilization device 26. Transformer 12 preferably has a secondary voltage of ten to twenty-five percent of the normal line voltage; accordingly, the added output voltage can be effective to maintain the output voltage $V_{OUT}$ applied to device 26 within the desired normal range.

For high-voltage compensation, when the input voltage $V_{IN}$ to compensation device 11 exceeds a second threshold value, above the normal range for system 26, the high input voltage to circuit 11 input causes sensor 18 to actuate switching circuit 20 to connect the main transformer primary 16 to conductor 22. In this instance, however, the orientation of the primary winding connection is reversed as compared with low-voltage compensation. Thus, in high-voltage compensation the secondary output from transformer 12 is in bucking relation to the primary and subtracts from the incoming line voltage $V_{IN}$. Consequently, the output A.C. voltage $V_{OUT}$ is reduced, and can be held to a level within the acceptable input voltage range for device 26. Low-voltage and high-voltage compensation, using device 11, are not mutually exclusive. The circuit of device 11 can be constructed to provide both, as in the circuits described hereinafter in regard to FIG. 2.

Some exemplary voltage values for $V_{IN}$ and $V_{OUT}$ are worth noting. For an A.C. line voltage that is nominally one hundred seventeen volts, a low voltage threshold may be established at one hundred volts. A high voltage threshold for the same line may be established at one hundred thirty-four volts, assuming that utilization device 26 is operable over a normal range of one hundred to one hundred thirty-four volts A.C. without appreciable damage. Similarly, for a utilization system 26 rated at a nominal 220V A.C., the low voltage threshold may be 200V and the high voltage threshold 240V. Switching circuit 20 and sensor 18 are preferably configured to afford a hysteresis of a few volts to preclude excessive "hunting". The hysteresis may be from two volts to five or more volts.

Figure 2:
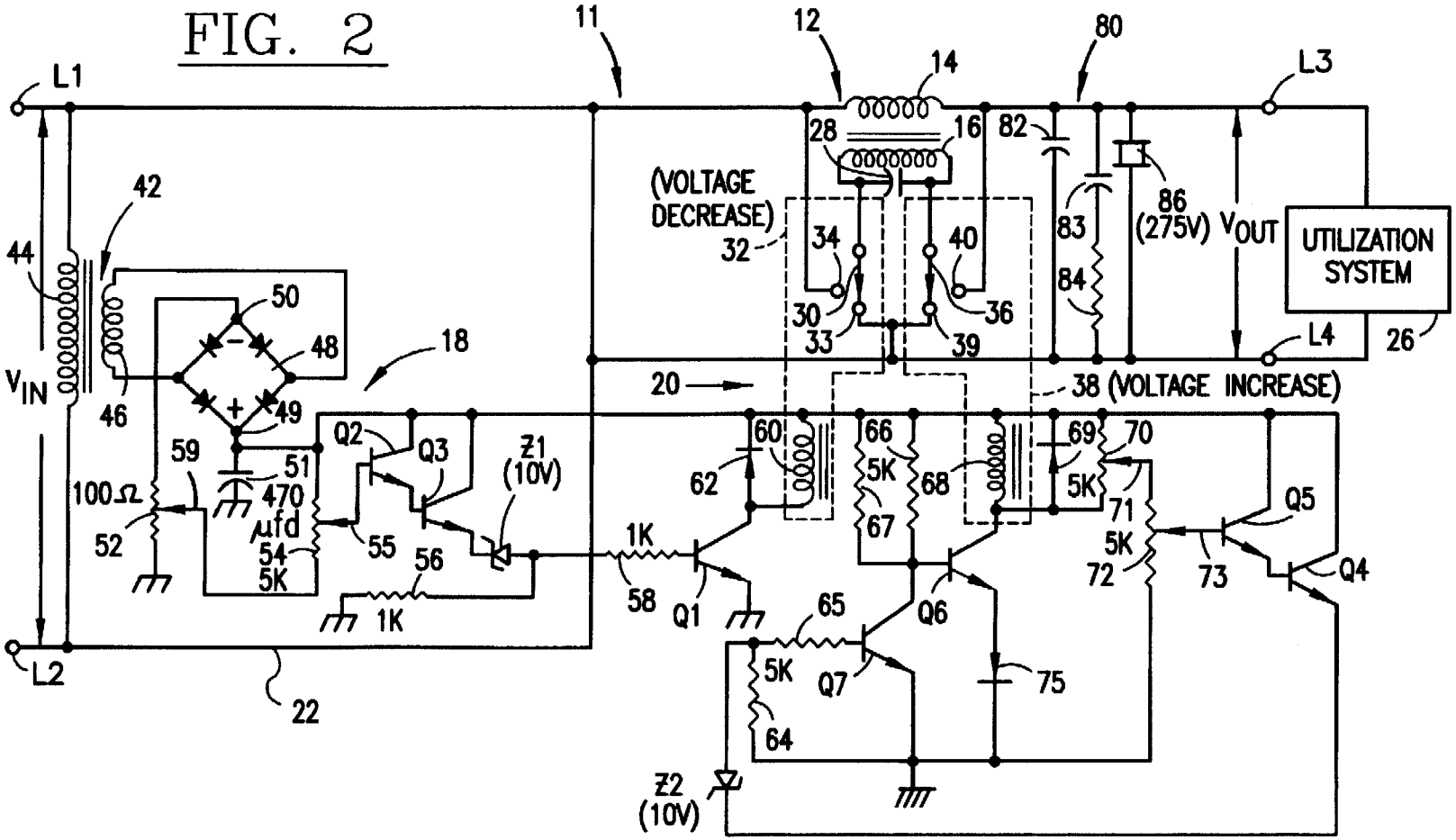
FIG. 2 is a more complete circuit diagram of one embodiment of the voltage compensation device of FIG. 1.

FIG. 2 is a circuit diagram of a preferred construction for device 11 in the system 10 of FIG. 1, in an embodiment of the invention that compensates for line voltage excursions both above and below a normal voltage range. As in FIG. 1, the secondary winding 14 of transformer 12 is connected in series between input terminal L1 and output terminal L3. The transformer 12 has a primary:secondary ratio of 5:1; other ratios may be used. A capacitor 28 is preferably connected across the primary winding 16 of the main transformer 12. One end of primary 16 is connected to the movable contact 30 of a voltage decrease relay 32 included in a switching circuit 20. Relay 32 has two fixed contacts 33 and 34, each engageable by movable contact 30. The other end of winding 16 is connected to the movable contact 36 of another relay, a voltage increase relay 38; movable contact 36 is engageable with either of two fixed contacts 39 and 40.

In the circuit for device 11 shown in FIG. 2 the voltage sensor 18, located at the left-hand side of the drawing, comprises a sensor transformer 42 having a primary winding 44 electromagnetically coupled to a secondary winding 46. Device 42 is a step-down transformer; the primary/secondary voltage ratio is typically 10:1 or more. The opposite ends of its secondary winding 46 are connected to the input terminals of a rectifier bridge 48 that has a positive output terminal 49 and a negative bridge terminal 50. The negative output terminal 50 is returned to system ground through a potentiometer 52, and the positive terminal 49 is coupled to system ground through a capacitor 51. A conductor 22 connects terminals L2 and L4. An arc-suppression capacitor 53 is connected between conductor 22 and input terminal L1.

The positive terminal 49 of rectifier bridge 48 is also connected to a conductor 23 and to one end of a potentiometer 54; the other end of potentiometer 54 is connected to the tap 59 of potentiometer 52. The tap 55 of potentiometer 54 is connected to the base of a transistor Q2 that is connected in a Darlington configuration with another transistor Q3. The collectors of both transistors Q2 and Q3 are connected to terminal 49 of rectifier bridge 48 by conductor 23. The emitter of transistor Q2 is connected to the base of transistor Q3. The emitter of transistor Q3 is connected to a Zener diode Z1 that has a connection through a resistor 56 to ground and another connection through a resistor 58 to the base of a relay driver transistor Q1. The emitter of transistor Q1 is connected to system ground; the collector of transistor Q1 is connected to one end of the operating coil 60 of the voltage decrease relay 32. The other end of coil 60 is connected by conductor 23 to bridge terminal 49. A diode 62 is connected in parallel with relay coil 60.

As noted, relay 32 is a voltage decrease relay; it is a part of switching circuit 20 (see also FIG. 1). In the circuit shown in detail in FIG. 2, the other relay 38 is also actuated from sensor 18. Relay 38 functions to increase the output voltage $V_{OUT}$ when the input voltage $V_{IN}$ is below the normal voltage range desired or necessary for a utilization system 26, FIG. 1.

The actuation circuit for the voltage increase relay 38, in FIG. 2, includes two Darlington-connected transistors Q4 and Q5, each having its collector electrode connected to conductor 23 and hence to bridge terminal 49. The emitter of transistor Q5 is connected to the base of transistor Q4; the emitter of transistor Q4 is connected to a Zener diode Z2 that is in turn connected to one end of each of two resistors 64 and 65. Resistor 64 is returned to system ground. Resistor 65 is connected to the base of a transistor Q7 that has its emitter returned to system ground and its collector connected to the base of a relay driver transistor Q6.

The base of transistor Q6 (and collector of Q7) is connected by conductor 23 to the positive rectifier bridge terminal 49 through two parallel resistors 66 and 67. The emitter of relay driver transistor Q6 is returned to ground through a diode 75. The collector of transistor Q6 is connected to one end of the operating coil 68 of relay 38. A diode 69 is in parallel with relay coil 68. The collector of transistor Q6 is also connected to one end of a potentiometer 70; the other end of potentiometer 70 is returned to rectifier bridge terminal 49 via conductor 23. The tap 71 of potentiometer 70 is connected to one end of another potentiometer 72. The other end of potentiometer 72 is returned to system ground and the tap 73 of potentiometer 72 is connected to the base of transistor Q5. This completes the actuation circuit for coil 68 of the voltage increase relay 38 in switching circuit 20.

Compensation device 11, in the configuration shown in FIG. 2, is provided with a transient filter and suppressor circuit 80. Circuit 80 includes an arc-suppression capacitor 82 connected across the output terminals L3 and L4. The series combination of another arc-suppression capacitor 83 and a resistor 84 is also connected across terminals L3 and L4. Capacitors 82 and 83 may each be 2 μfd to 20 μfd; either may be omitted. Circuit 80 further includes an MOV voltage-breakdown device 86 connected across output terminals L3 and L4 to afford some additional transient protection to system 26.

Figure 3A:
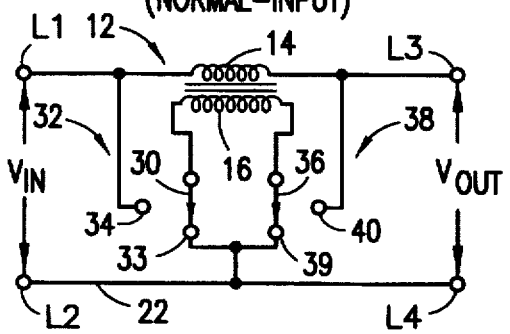
FIGS. 3A, 3B and 3C are circuit drawings showing the connections for a transformer in the circuit of FIG. 2 for normal, low, and high input voltages, respectively.
Figure 3C:
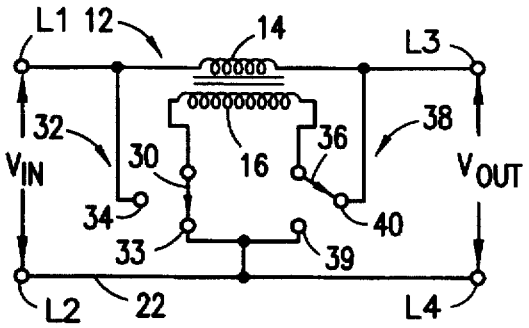
Figure 3B:
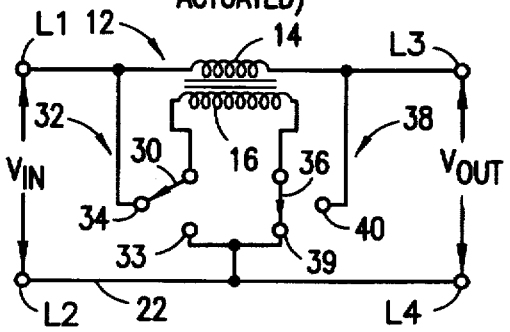

Operation of the combined under-voltage and over-voltage compensation circuit 11 illustrated in FIG. 2 can now be considered in conjunction with the circuits shown in FIGS. 3A, 3B, and 3C. For this explanation, the "normal" or acceptable voltage range for the utilization system 26 (FIGS. 1 and 2) is taken as one hundred volts (A.C.) to one hundred thirty four volts. A low input voltage $V_{IN}$ is any voltage below one hundred volts A.C.; a high input voltage $V_{IN}$ is a voltage in excess of one hundred thirty four volts. These ranges are selected arbitrarily; they depend upon the requirements of utilization device 26.

The purpose and capability of the compensation circuit 11 is to add to the $V_{IN}$ input from an A.C. power line when that voltage $V_{IN}$ is low and to reduce the $V_{IN}$ input voltage from the A.C. line when that input voltage $V_{IN}$ is excessive, while minimizing switching requirements. In both instances, the input voltage to the utilization system 26, which is the output $V_{OUT}$ from terminals L3 and L4 of device 11, should maintain energization of system 26 within acceptable limits. Compensation is effected by the actions of relays 32 and 38 and their connections to the primary winding 16 of main transformer 12.

When the input voltage $V_{IN}$ is within the normal range for system 26, taken as 100–134 V. A.C., the primary 16 of main transformer 12 is effectively disconnected from the operating circuit for system 26; in the circuit of FIG. 2 primary 16 is shorted out. This is the condition shown in FIG. 3A.

When there is an input voltage $V_{IN}$ below the range required for system 26, the primary 16 is connected in phase to add to the line voltage. This condition is shown in FIG. 3C. When the input voltage $V_{IN}$ is excessive the transformer primary is connected in phase opposition or bucking relation to the input voltage developed in secondary 14 to reduce the voltage to system 26. This is the condition illustrated in FIG. 3B. A fundamental advantage of this invention is that all power line switching is accomplished at the primary 16 of transformer 12 and at a current much smaller than the total current to the utilization system 26. For example, if the primary/secondary ratio of transformer 12 is 5:1, a current of ten amperes can be controlled with only two amperes actually switched.

Thus, for normal operation within the input voltage range acceptable for utilization system 26, the operating condition for the relays in the circuit of FIG. 2 is as illustrated in FIG. 3A. The primary winding 16 of transformer 12 is shorted out through connection of relay contacts 30 and 36 to line 22. Thus, in effect the primary winding 16 of the transformer 12 is disconnected and the normal range input $V_{IN}$ is applied, without appreciable change, from input terminals L1 and L2 to output terminals L3 and L4 and hence to system 26. Losses in circuit 11 (FIG. 2) are negligible.

When the input voltage $V_{IN}$ is below the desired normal range and the voltage at the base of transistor Q2 in the circuit of FIG. 2 exceeds the voltage rating of Zener diode Z1, current supplied to the base of transistor Q1 results in conduction through potentiometer 52, so that coil 60 of relay is energized to actuate the voltage decrease relay 32. The Darlington-connected transistors Q2 and Q3 afford maximized sensitivity. The result is an incremental increase in the voltage at the base of transistor Q2, which causes this part of the switching circuit 11 to exhibit some controlled hysteresis, so that "hunting" is minimized. With the voltage decrease relay 32 actuated the operating condition is a shown in FIG. 3B with movable relay contact 30 engaging fixed contact 34. The other movable relay contact 36, in relay 38, remains engaged with fixed relay contact 39. The A.C. voltage developed in transformer secondary 14 is subtracted from the output voltage $V_{OUT}$ at terminals L3 and L4. Thus, the A.C. input $V_{IN}$ that is too high, is reduced, back to the optimal range for system 26 (FIG. 2).

When the input voltage $V_{IN}$ is below the desired normal range the voltage increase relay 38 (FIG. 2) is actuated, resulting in the operating condition illustrated in FIG. 3C. Now, primary 16 is in the operating circuit. The A.C. voltage developed in the secondary 14 of transformer 12 adds to the voltage of primary 16, thus increasing the output voltage $V_{OUT}$ at terminals L3 and L4. Potentiometer 70 (FIG. 2) causes relay 38 to exhibit controllable hysteresis, depending upon the setting of the potentiometer; again, hunting is minimized.

When the circuit illustrated in FIG. 2 is first energized, as when device 26 is first switched on, the primary 16 of transformer 12 is shorted out, as shown in FIG. 3A, because relays 32 and 38 are both de-energized. This condition applies until capacitor 51 charges fully. When capacitor 51 charges slowly, relay 38 is actuated, so that a "low-input" condition is simulated; see FIG. 3C. But when capacitor 51 reaches a charge within the "normal" range, relay 38 drops out, and the normal voltage condition (FIG. 3A) is resumed. Thereafter, operation is as previously described.

In FIG. 2, values are provided for most of the components of circuit 11. Transistors are all NPN, and may be type IN758, and diodes may be type IN400. Relays 32 and 38 may comprise virtually any desired type. The preferred primary/secondary ratio for main transformer 12 is 100:15; for sensor transformer 42 that ratio is 100:10. Typical actuation levels for relays 32 and 36, assuming 117 volts in the mid-point of a normal voltage range of 100 to 134 volts, are:

Increase Relay 38

Actuated at 50% of normal (58.5V) on energization.
Opened at 90% of normal (105.3V)
Closed at 85% of normal (98.5V).

Decrease Relay 32

Actuated at 110% of normal (128.7V)
Stays actuated to 200% of normal (234V)
Opened at 100% of normal (117V)

Figure 4:
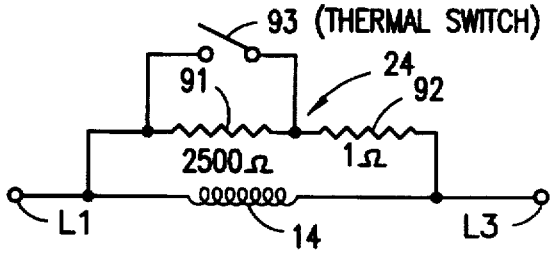
FIG. 4 is a diagram of one embodiment of the bypass protector circuit of FIG. 1.

FIG. 4 affords a simple circuit that can be used for the bypass protector 24. In the circuit 24 illustrated in FIG. 4, a first (sensor) resistor 91 and a second (hold) resistor 92 are connected in series with each other across the transformer secondary 14 (see FIGS. 1 and 2). A thermally actuated switch 93 is open, as illustrated in FIG. 4; when heat from resistor 91 heats switch 93 above a given temperature the switch 93 closes. The resistor parameters shown in FIG. 4 are for a 240 volt compensation circuit; for a 117 volt compensation circuit, the sensor resistor 91 would be appreciably smaller.

The heat developed in sensor resistor 91 is a function of the square of the current across that resistor multiplied by its resistance. Resistor 91 heats rapidly, closing switch 93 and effectively connecting terminals L1 and L3 to bypass transformer secondary 14. The low hold resistance 92, only one ohm, produces only enough heat to hold switch 93 actuated (closed). The purpose of bypass circuit 24 is to keep power "on" to utilization device 26 even if the compensation device 11 fails. If desired, an additional thermal switch in the same location as switch 93 can be used for an indicator drive or an alarm signal indicative of failure of the voltage compensation circuit.

Figure 5:
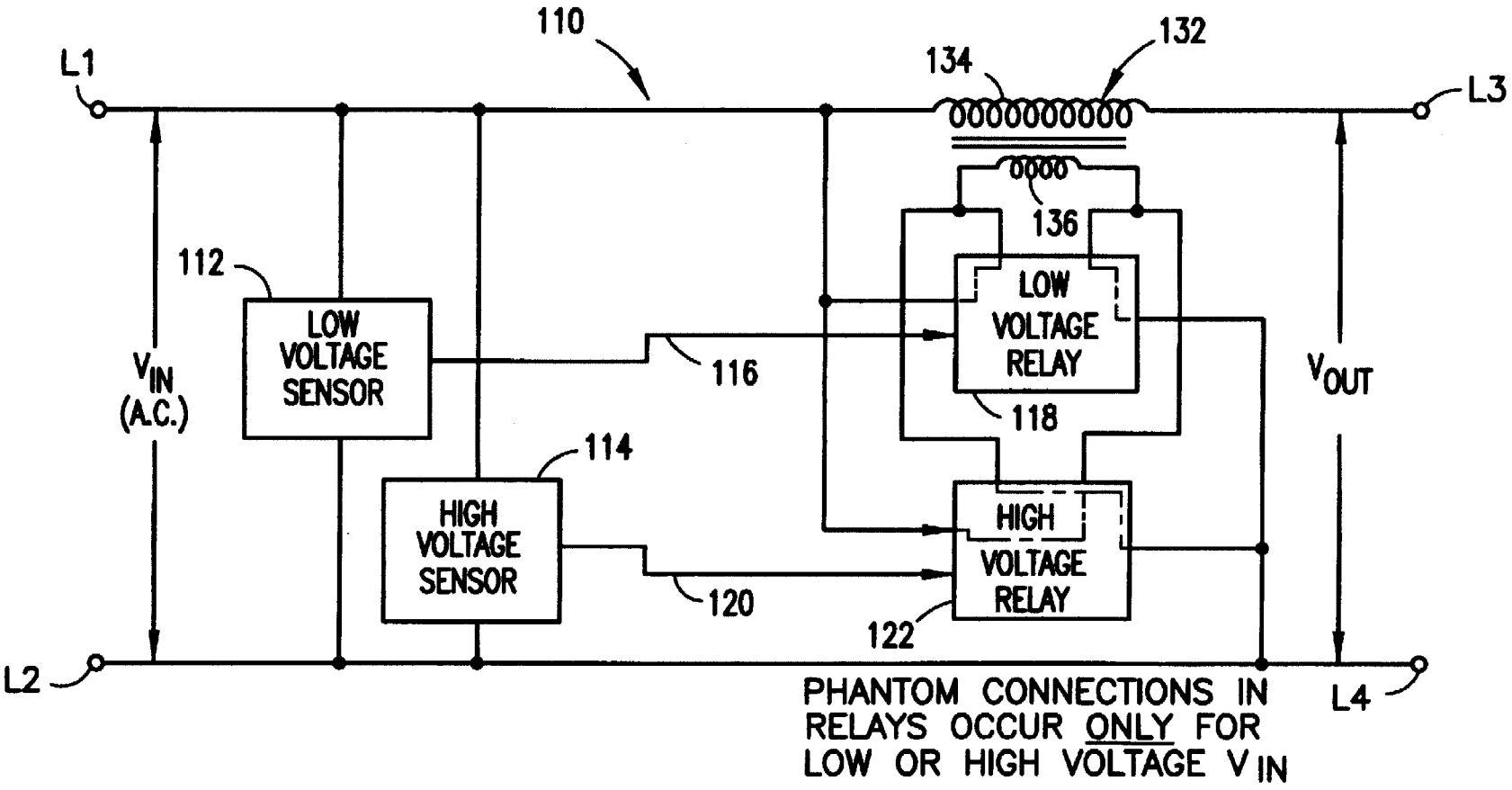
FIG. 5 is a simplified, general block diagram of the compensation device of the invention.

FIG. 5 affords a block diagram of the invention, applicable to a relatively complete re-design of the circuits of FIGS. 1, 2 and 3A–3C. Thus, the device 110 illustrated in FIG. 5 constitutes a modified embodiment of the same invention as previously described. There are two line input terminals L1 and L2 for connection to an A.C. supply. The A.C. supply (not shown) is such that the input voltage $V_{IN}$ across terminals L2 and L2 is subject to voltage variations both above and below a predetermined acceptable input voltage range. The output $V_{OUT}$, across the voltage terminals L3 and L4, is to be maintained within that acceptable range despite such input variations.

Compensation device 110, FIG. 5, includes two separate voltage sensor circuits 112 and 114 for sensing the input voltage $V_{IN}$; each is connected across the input terminals L1 and L2. The sensor 112 is a low voltage sensor responsive to variations of the input voltage $V_{IN}$ below the acceptable range. It generates a low voltage actuation signal that is applied, via a conductor 116, to a low voltage (voltage increase) relay 118. The other sensor 114 is responsive to variations of the input voltage $V_{IN}$ above the acceptable range. It generates a high voltage actuation signal that is supplied, via a conductor 120, to a high voltage (voltage decrease) relay 122.

The compensation device 110 of FIG. 5 further comprises a transformer 132 having a primary:secondary ratio of 2:1 or more, preferably about 5:1. The primary winding 136 of transformer 132 is connected to each of the relays 118 and 122. The secondary winding 134 of transformer 132 is connected in series between the terminals L1 and L3. Of course, the transformer windings 134 and 136 are electromagnetically coupled to each other as in any transformer. The phantom line connections shown in the relays 118 and 120 occur only when those relays are actuated. When the input voltage $V_{IN}$ is within the acceptable range, neither relay is actuated and the transformer primary 136 is effectively de-energized; it is then not effective and the output voltage $V_{OUT}$ is approximately the same as the input voltage $V_{IN}$.

Operation of voltage compensation device 110, FIG. 5, is similar to that of the previously described embodiment of the invention. When the input voltage $V_{IN}$ is within the desired range for a utilization device or system (not shown) connected to the output terminals L3 and L4, the output voltage $V_{OUT}$ is approximately the same as the input voltage $V_{IN}$. If the input voltage falls below the desired range for any appreciable period, this condition is sensed by the sensor 112 and the relay 118 is actuated to incorporate transformer primary 136 in the operating circuit in adding relation to the smaller voltage now developed by the transformer secondary 134. For a high input voltage $V_{IN}$, above the acceptable range, the excessive input voltage is sensed by the sensor 114, which actuates the relay 122 to connect the primary 136 into the circuit in bucking relation to the secondary 134, so that output voltage $V_{OUT}$ is reduced. The two relays are not both activated at any given time.

It will be recognized that one voltage sensor can perform the functions of both of the devices 112 and 114. Indeed, that is the arrangement afforded in the embodiment of FIGS. 1 and 2. The invention does entail switching of just one winding of the transformer 132, preferably its primary, so that switching current requirements in the relays 118,122 are appreciably less than the total current to a utilization device or system connected to output terminals L3 and L4.

For some utilization devices or systems (e.g. air conditioners) a high voltage condition may be quite unlikely but a low voltage condition may be more likely and more dangerous. For such devices, sensor 114 and relay 122 (FIG. 5) may be omitted, so that device 110 compensates only for a low input voltage $V_{IN}$. Other devices or systems may tolerate low input voltages but may be much more susceptible to damage if the input voltage exceeds their acceptable range. In this situation, sensor 112 and relay 118 may be superfluous and can be omitted, so that device 110 compensates only for a high input voltage $V_{IN}$. For many systems (e.g. telephone and other communication systems) compensation for both high and low input voltage conditions are desirable. It will be recognized that in any embodiment of the invention the designations "primary" and "secondary" for the main transformer are essentially arbitrary.

Figure 6:
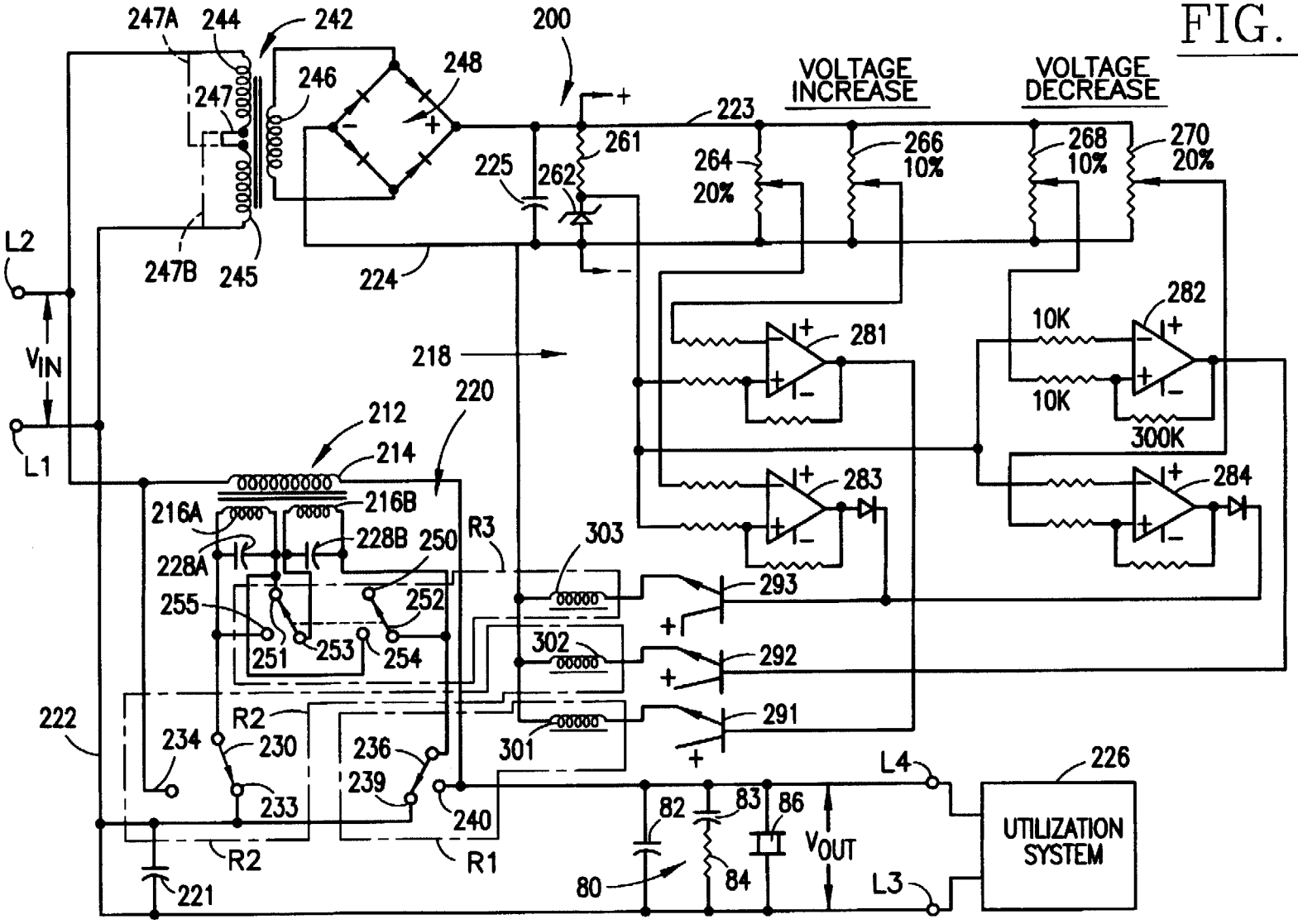
FIG. 6 is a circuit diagram of another preferred embodiment of the invention.

FIG. 6 illustrates a device 200 constituting a further embodiment of the invention; device 200 compensates for line voltage excursions both above and below a normal operating range. Moreover, device 200 is readily adaptable to two different normal input voltage ranges and affords two levels of compensation for both under-voltage and over-voltage conditions. The device 200 includes a main input transformer 212 having a secondary winding 214 connected in series between one line terminal L2 and an output terminal L4. In this embodiment, however, the primary winding of transformer 212, electromagnetically coupled to the secondary winding 214, includes two separate winding sections 216A and 216B. A capacitor 228A may be connected across winding 216A; a similar capacitor 228B is shown connected in parallel with transformer winding 216B. One end of winding 216A is connected to the movable contact 230 of a single-pole double-throw relay R2 in a switching circuit 220. Relay R2 has two fixed contacts 233 and 234, each engageable by movable contact 230.

One end of transformer winding 216B is connected to the movable contact 236 of another single-pole double-throw relay R1 having two fixed contacts 239 and 240. The fixed contact 234 of relay R2 is connected to one end of transformer winding 214 and to input terminal L2; the fixed contact 240 of relay R1 is connected to the other end of transformer winding 214 and to the output terminal L4. The fixed contacts 233 (relay R2) and 239 (relay R1) are both connected to a conductor 222 that connects the input terminal L1 to the output terminal L3. A capacitor 221 is connected across the input terminals L1 and L2.

The end of transformer winding section 216A that is not connected to the movable contact 230 of relay R2 is connected to one fixed contact 251 of a double-pole double throw relay R3 that includes two movable contacts 252 and 253. The fixed contact 251 of relay R3 is connected to the end of the transformer winding 216A that is not connected to the movable contact 230 of relay R2. The movable contact 253 is shown engaged with fixed contact 251, but is also engageable with a second fixed contact 255 connected to the movable contact 230 of relay R2. The movable contact 252 is shown engaged with an open-circuited fixed contact 250; it is also engageable with another fixed contact 254 of relay R3. The movable contacts 252 and 253 of relay R3 are connected to opposite ends of the transformer winding 216B, with the movable contact 252 of relay R3 also connected to the movable contact 236 of relay R1. The two movable contacts 252 and 253 of relay R3 are interconnected for joint and simultaneous movement.

In FIG. 6 relays R1,R2 and R3 are all shown unactuated, as in the case when $V_{IN}$ in FIG. 6 is within the normal operating range for a utilization system 226 connected to output terminals L4 and L3 of switching circuit 220.

The circuit of FIG. 6 may include a transient filter and suppressor circuit 80 connected between output terminals L3 and L4 and switching circuit 220. As before, circuit 80 includes the capacitors 82 and 83 and a resistor 84 and may also include an MOV voltage-breakdown device 86 for transient protection.

The voltage sensor or controller circuit 218 in the embodiment 220 of FIG. 6 includes a diode rectifier bridge 248. Bridge 248 is connected across the secondary winding 246 of a sensor transformer 242. The primary winding of transformer 242 includes two sections 244 and 245 that can be connected in series, as shown, as by a shunt 247. Shunt 247 is used when the device 200 is employed with an input line L1, L2 having a nominal voltage of 230 volts. By removing shunt 247 and replacing it with two shunts, as indicted by phantom lines 247A and 247B, thus connecting primary winding sections 244 and 245 in parallel, conversion to operate on an input line having a nominal voltage of 115 volts is easily effected.

The positive terminal 249 of bridge 228 is connected to a conductor 223; the negative terminal 250 of the bridge is connected to a conductor 224. A capacitor 225 may be connected between conductors 223 and 224. The series combination of a resistor 261 and a zener diode 262 is also connected between conductors 223 and 224. There are also two voltage increase sensor potentiometers 264 and 266 and two voltage decrease sensor potentiometers 268 and 270, all of the potentiometers being connected across the two conductors 223 and 224. Fixed-tap resistors could be used instead of the control potentiometers.

In the controller circuit 218 of the embodiment of FIG. 6 there are four operational amplifiers 281,282,283 and 284, which may be in one integrated circuit. Each amplifier is connected in a Schmitt trigger configuration with appropriate resistors in series with the + and – inputs of the amplifier and with a much larger feedback resistor from the amplifier output back to its + input. The exemplary resistance values shown for amplifier 282 may be used for all of the amplifiers. Amplifiers 283 and 284 each have a blocking diode connected to the amplifier output. The tap on potentiometer 264 is connected to the – input of amplifier 283. The tap on the other voltage increase potentiometer 266 is connected to the – input of amplifier 281. The tap on the voltage decrease control potentiometer 268 is connected to the + input of amplifier 282, whereas the tap on the other voltage decrease control potentiometer 270 is connected to the + input of amplifier 282. The remaining input terminals of the amplifiers 281–284 (+ input terminals for 281 and 283, – input terminals for 282 and 284) are all connected to the reference voltage afforded by the junction of resistor 261 and zener diode 262.

The output of amplifier 281 is connected to the base of a transistor 291. The collector of transistor 291 is connected to the positive voltage supply (conductor 223). The emitter of transistor 291 is connected to one end of the operating coil 301 for the relay R1. The other end of coil 301 is returned to conductor 224. The output circuit for amplifier 282 is essentially similar. It includes a transistor 292 having its emitter connected to the operating coil 302 of relay R2 and having its base connected to the output of amplifier 282. Each of the two amplifiers 283 and 284 has its output connected to the base of a transistor 293. The emitter of transistor 293 is connected to the operating coil 303 of the relay R3. It will be recognized that the contacts of relays R1–R3, and their connections, have previously been described.

The operation of the device of FIG. 6 is similar to the previously described embodiments of the invention. FIG. 6 shows the positions of the movable relay contacts 230,236, 252 and 253 when the input voltage $V_{IN}$ across line terminals L1 and L2 is within the normal range for operation of the utilization system 226. The primary windings 216A and 261B of the transformer 212 in the voltage control or switching circuit 220 are both connected to line 222, through the contacts of relays R1 and R2. The outputs from the potentiometers 264,266,268 and 270 are not sufficient to actuate any of the Schmitt trigger circuits comprising amplifiers 281–284. The relay coils 301–303 remain unenergized and the output voltage $V_{OUT}$ across the output terminals L3 and L4 is approximately the same as the input voltage $V_{IN}$ at the input terminals L1 and L2. It is assumed that the input voltage $V_{IN}$ is centered around 230V and does not drop more than 10% (207V) or rise more than 10% (253V). As long as the input voltage $V_{IN}$ remains within the limits of 207V to 253V, the device 200 has no measurable effect on the operation of system 226.

Figure 7A:
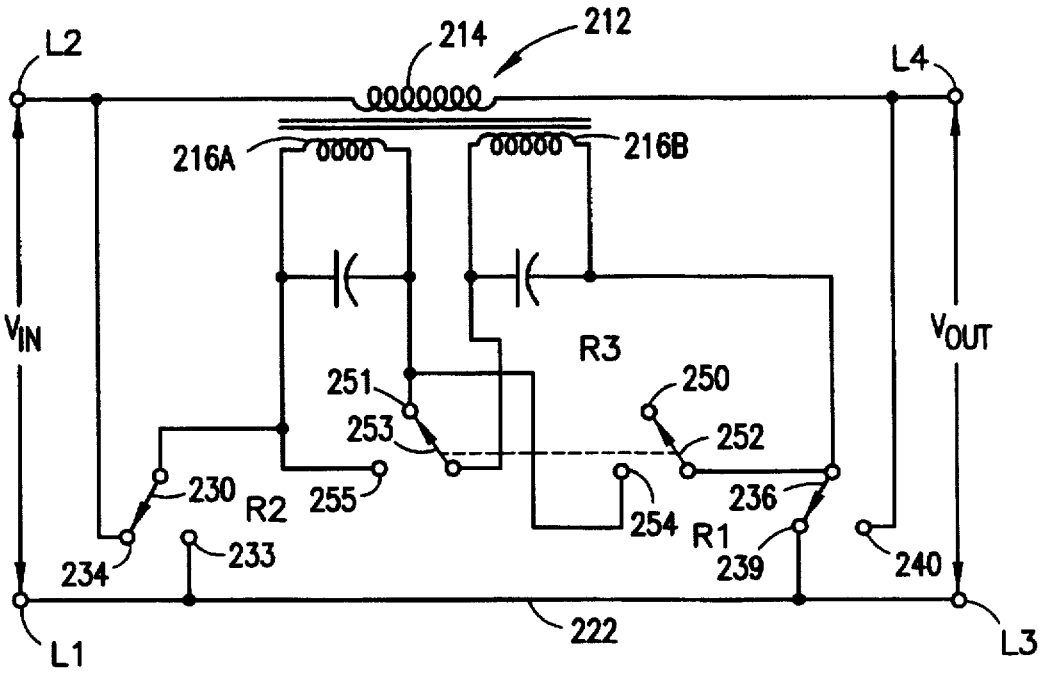
FIGS. 7A, 7B, 7C and 7D are circuit drawings illustrating the connections for a transformer in the circuit of FIG. 6 for low, very low, high, and very high input voltages, respectively.

Consider, then, the situation that obtains when the input voltage goes above the upper threshold, 253V, of the normal range, but is less than a 20% increase, which would be 276V. The outputs of potentiometers 264,266 and 270 do not actuate the Schmitt trigger circuits to which they are connected. But the output from potentiometer 268 is now adequate to energize the operating coil 302 of relay R2 and actuate that relay. This produces the operating condition shown in FIG. 7A; only relay R2 is actuated, its movable contact 230 disengaging from its fixed contact 233 and engaging its contact 234. The primary windings 216A and 216B of transformer 212 are now connected in series with each other. The voltage the primaries 216A and 216B induce in the secondary winding 214 of transformer 212 (FIG. 6) is in bucking relation to the input voltage and maintains the output voltage $V_{OUT}$ for system 226 within its "normal" range.

Figure 7B:
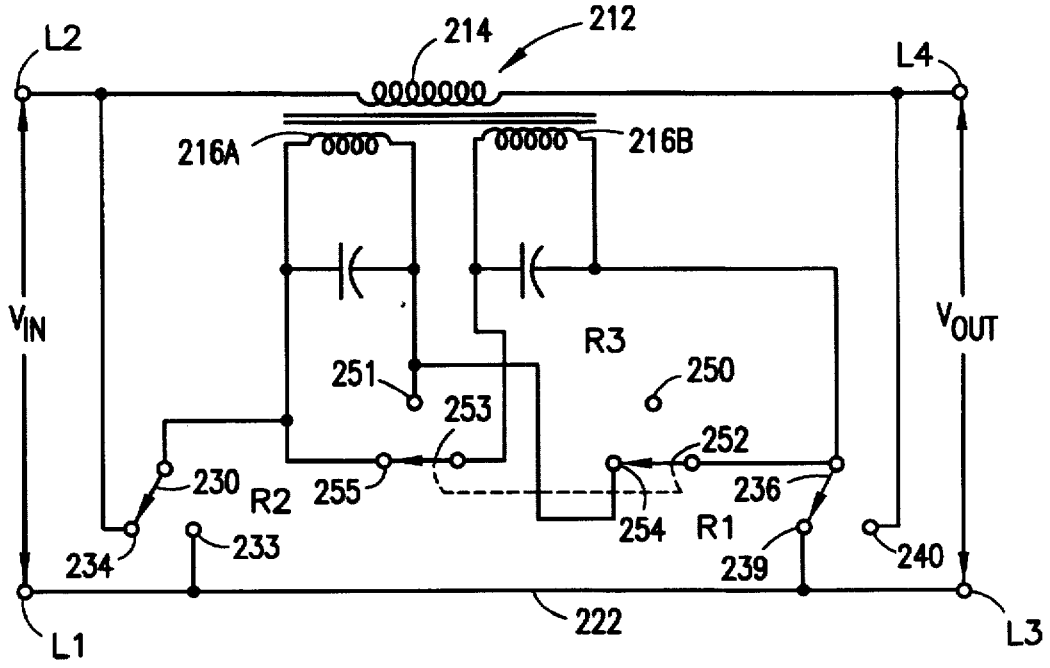

A further increase in the input voltage may well occur, to a level above the 20% threshold of 276V. In that event, potentiometer 270 and its Schmitt trigger circuit comprising amplifier 284 energize coil 303 of relay R3. Relay R3 is now actuated, and relay R2 remains actuated. This is the operating condition shown in FIG. 7B. The primary windings 216A and 216B of transformer 212 are each connected across the line terminals leading to the load, system 226 (FIG. 6), but now they are in parallel with each other rather than in series. They are still in bucking relation; the voltage they induce in transformer winding 214 subtracts from the over-voltage at $V_{IN}$. Device 200 continues to maintain the input voltage to system 226 within its desired range.

Figure 7C:
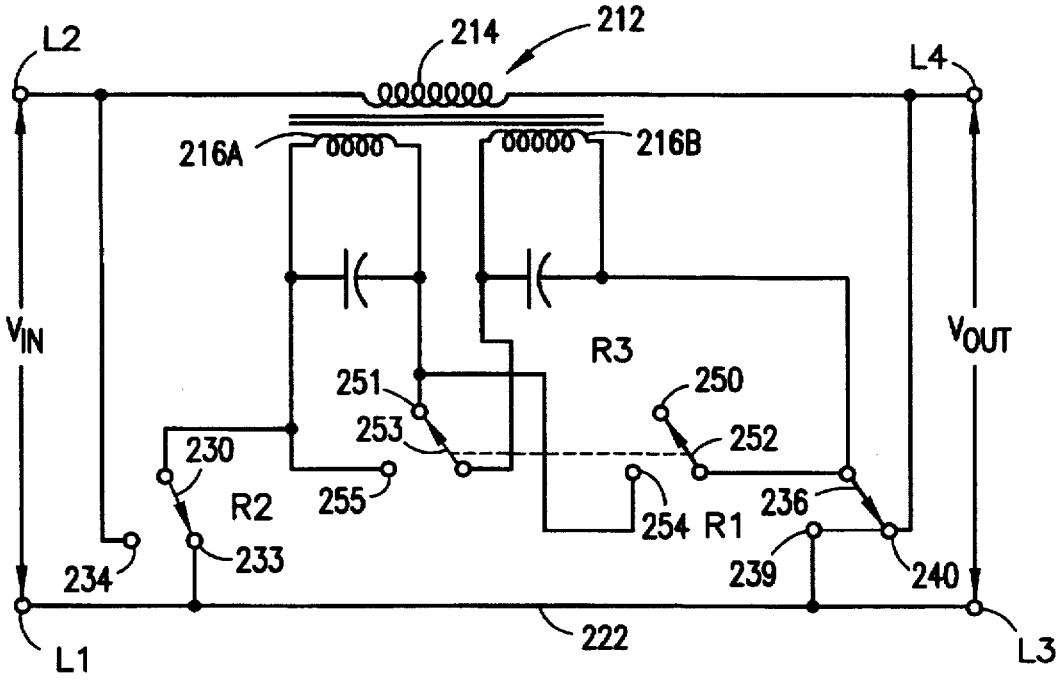

Another condition that may occur is a drop in the input voltage to a level below a 10% threshold (207V) but still above a 20% threshold (184V). This results in energization of only the operating coil 301 of relay R1 by means of potentiometer 266 and the circuit comprising amplifier 281 (FIG. 6). The other relay coils 302 and 303 remain de-energized. The resulting condition, shown in FIG. 7C, has the primary windings 216A and 216B energized in series but in the opposite sense from that described above for FIG. 7A. That is, the induced voltage in the secondary winding 214 of transformer 212 adds to (increases) the output voltage $V_{OUT}$ supplied to utilization system 226, FIG. 6.

Figure 7D:
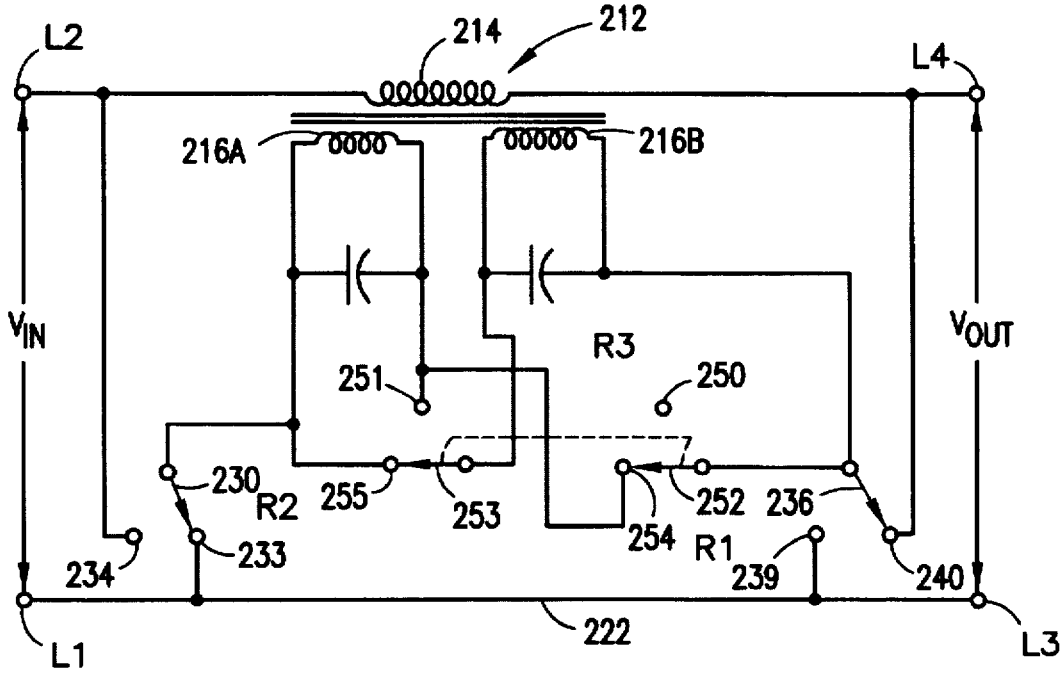

FIG. 7D shows the remaining condition, when relay R1 is still energized, as described immediately above, but the input voltage $V_{IN}$ drops below a 20% threshold, to less than 184V. When this occurs, the operating coil 303 of relay R3 is again energized, this time by the circuit comprising potentiometer 264, amplifier 283, and transistor 293, FIG. 6. With relays R1 and R3 both actuated, as shown in FIG. 7D, the primary windings 216A and 216B are still energized but in parallel rather than series. The circuit 200 (FIG. 6) continues to maintain the output voltage to system 226 within its normal range.

To summarize operation of device 200, FIG. 6, whenever there is an under-voltage condition at L1, L2, between 10% and 20% below the normal range centered on a nominal voltage of 230V, the primary windings 216A and 216B of the main transformer 212 are connected in series and in additive relation relative to the secondary winding 214. For an even greater under-voltage condition, more than 20%, the primary windings are connected in parallel. For an over-voltage condition, the action is the same except that the primary windings are in bucking relation to the secondary winding in the transformer 212. In either case, if the under-voltage or over-voltage condition abates, the relays R1–R3 are de-energized and return to the operating condition illustrated in FIG. 6. The utilization system 226 is always supplied with an energizing voltage within its normal range.

The foregoing discussion assumes that the tolerance of system 226 for over-voltage and under-voltage conditions is symmetrical about some nominal voltage, taken 230V for FIG. 6. Such symmetry may not obtain; the permissible lower threshold for the normal range may be greater than the permissible higher threshold, or vice versa. An asymmetrical situation is readily met by adjustment of the sensor potentiometers 264,266,268 and 270 to suit the needs of utilization system 226. Similar adjustment for other embodiments of the invention is equally convenient. In all instances, some limited hysteresis in the sensing and relay actuation portions of the compensation device is desirable to preclude "hunting".

I claim:

1. A voltage compensation device for an A.C. line subject to variations both above and below a predetermined normal line voltage range, the compensation device comprising:

first and second input terminals connectable to an A.C. line to derive an input voltage $V_{IN}$ therefrom, which A.C. Line is subject to variations both above and below a predetermined normal line voltage range;

first and second output terminals connectable to a utilization device;

a transformer having first and second electromagnetically coupled windings;

sensor means, connected to the input terminals, for generating an actuating signal indicative of the voltage between the input terminals; and switching means, connected to one winding of the transformer and to the sensor means, actuated by the actuating signal from the sensor means, for:

(A1) connecting the one winding of the transformer in additive relation to the other winding when the input voltage $V_{IN}$ is below a given low voltage threshold below the normal range;

(A2) connecting the one winding of the transformer in bucking relation to the other winding when the input voltage $V_{IN}$ is above a given high voltage threshold above the normal range; and (B) effectively disconnecting the one winding of the transformer when the input voltage is above the low voltage threshold and below the high voltage threshold;

in which the one winding of the transformer is in two sections, which sections are connected in series when the input voltage $V_{IN}$ is below a first low voltage threshold below the nominal range, in parallel when the input voltage is below a second low voltage threshold below the first low voltage threshold, in series when the input voltage $V_{IN}$ is above a first high voltage threshold above the nominal range, and in parallel when the voltage is above a second high voltage threshold above the first high voltage threshold.

2. A voltage compensation device for an A.C. line according to claim 1 in which:

the inter-winding voltage ratio of the transformer is greater than 2:1.

3. A voltage compensation device for an A.C. line according to claim 2 in which:

the inter-winding voltage ratio of the transformer is about 5:1.

4. A voltage compensation device for an A.C. line according to claim 1 in which, in step B:

the switching means shorts out the one winding of the transformer when the input voltage $V_{IN}$ is above the low threshold and below the high threshold, within the normal operating range.

5. A voltage compensation device for an A.C. line according to claim 1, in which the normal line voltage range has a nominal center voltage and in which the low voltage threshold is at least ten volts below the nominal center voltage and the high voltage threshold is at least ten volts above the nominal center voltage.

6. A voltage compensation device for an A.C. line according to claim 1, in which the other winding of the transformer is connected in series between one input terminal and one output terminal.

7. A voltage compensation device for an A.C. line according to claim 1, in which the sensor means comprises a plurality of sensor potentiometers and a corresponding plurality of Schmitt trigger circuits each connecting one sensor potentiometer to the switching means.

8. A voltage compensation device for an A.C. line according to claim 1, in which the sensor means includes a sensor input transformer having a split primary winding connectable to the A.C. line in series or in parallel to adapt the device for two distinctively different line voltages.

9. A voltage compensation device for an A.C. line subject to variations below a predetermined normal line voltage range, the compensation device comprising first and second input terminals connectable to A.C. line to derive voltage $V_{IN}$ therefrom, which A.C. line is subject to variations below a predetermined normal line voltage range;

first and second output terminals connectable to a utilization device;

a transformer having first and second electromagnetically coupled windings;

sensor means, connected to the input terminals, for generating an actuating signal indicative of a low voltage, below the normal line voltage range, between the input terminals; and switching means, connected to one winding of the transformer and to the sensor means, actuated by the actuating signal from the sensor means, for:

(A) connecting the one winding of the transformer in additive relation to the other winding when the input voltage $V_{IN}$ is below a given low voltage threshold below the normal range; and (B) effectively disconnecting the one winding of the transformer when the input voltage is above the low voltage threshold;

in which the one winding of the transformer is in two sections which are connected in series when the input voltage $V_{IN}$ is below a first low voltage threshold below the nominal range and in parallel when the input voltage is below a second low voltage threshold below the first low voltage threshold.

10. A voltage compensation device for an A.C. line according claim 1, in which the normal lane voltage range has a nominal center voltage and in which the low voltage threshold is at least ten volts below the nominal center voltage.

11. A voltage compensation device for an A.C. line subject to variations above a predetermined normal line voltage range, the compensation device comprising:

first and second input terminals connectable to an A.C. line to derive an input voltage $V_{IN}$ therefrom, which A.C. line is subject to variations above a predetermined normal line voltage range;

first and second output terminals connectable to a utilization device;

a transformer having first and second electromagnetically coupled windings exceeding 2:1;

sensor means, connected to the input terminals, for generating an actuating signal indicative of a high voltage, above the normal line voltage range, between the input terminals; and switching means, connected to one winding of the transformer and to the sensor means, actuated by the actuating signal from the sensor means, for:

(A) connecting the one winding of the transformer in bucking relation to the other winding when the input voltage $V_{IN}$ is above a given high voltage threshold above the normal range; and (B) effectively disconnecting the one winding of the transformer when the input voltage is below the high voltage threshold;

in which the one winding of the transformer is in two sections which are connected in series when the input voltage $V_{IN}$ is above a first high voltage threshold above the nominal range and in parallel when the input voltage is above a second high voltage threshold above the first high voltage threshold.

12. A voltage compensation device for an A.C. line according to claim 11, in which the normal line voltage range has a nominal center voltage and in which the given high voltage threshold is at least ten volts above the nominal center voltage.

* * * * *